United States Patent [19]

Block

[11] 3,977,039

[45] Aug. 31, 1976

[54] AIR BLAST SWEEPER WITH DUST CONTROL SYSTEM

[75] Inventor: Thomas S. Block, Muskegon, Mich.

[73] Assignee: Clarke-Gravely Corporation, Muskegon, Mich.

[22] Filed: Feb. 5, 1975

[21] Appl. No.: 547,224

[52] U.S. Cl. ..... 15/346; 15/340; 15/347; 55/220

[51] Int. Cl.[2] ..... A47L 5/14; A47L 9/00; A47L 9/18

[58] Field of Search ..... 15/340, 345, 346, 347, 15/352, 353, 354; 55/220

[56] References Cited

UNITED STATES PATENTS

| | | | |
|---|---|---|---|
| 983,293 | 2/1911 | Kündig-Honegger | 15/340 X |
| 1,071,301 | 8/1913 | Diserens | 15/346 |
| 1,247,654 | 11/1917 | Farnsworth | 15/346 |
| 2,916,761 | 12/1959 | Öberg | 15/340 X |
| 3,447,188 | 6/1969 | Maasberg | 15/340 X |
| 3,662,427 | 5/1972 | Hanna | 15/346 |

*Primary Examiner*—Christopher K. Moore
*Attorney, Agent, or Firm*—Price, Heneveld, Huizenga & Cooper

[57] ABSTRACT

A mobile sweeper includes an air blast pickup head having air intake and exhaust ports communicating with the exhaust of a blower and the input of a debris plenum, respectively, for suctioning debris from a surface being cleaned and depositing the debris in the debris plenum. In order to control the dust caused by the air movement, a source of pressurized water is injected in the form of minute droplets into the air stream in advance of the pickup head air intake and in advance of the debris plenum input.

16 Claims, 7 Drawing Figures

AIR BLAST SWEEPER WITH DUST CONTROL SYSTEM

BACKGROUND OF THE INVENTION

The present invention relates to surface cleaning apparatus and particularly to such apparatus which employs an air blast pickup head.

In mobile sweepers fro cleaning debris from the surface of, for example, parking lots, roadways or the like, frequently air blast pickup heads are utilized to remove and collect debris from the surface being cleaned. In such systems, a blower forces air to a pickup head such that an air blast sweeps over the surface being cleaned. This loosens debris which is then withdrawn from the pickup head by a suction line returning to the blower input via a debris collection plenum. A sweeper having these basic structural characteristics is disclosed in U.S. Pat. No. 3,512,206 issued to M. W. Young on May 19, 1970.

A sweeper with this type of pickup head depends upon the maintenance of a relatively close coupling of the pickup head to the surface being cleaned such that the blast of air is effectively contained within the cleaning area for loosening and removing debris. In order to permit the ingestion of relatively large articles, at least the leading edge of the pickup head must have some clearance between its lower edge and the surface to be cleaned and preferably, it utilizes a flexible flap along the leading edge which deflects upon contact with an object and permits ingestion of such object. When the flap, however, is momentarily raised, the head is even more susceptible to the escape of air and dust particles which are turbulently circulated by the air stream.

The difficulty of ingesting both small and large particles of debris with a single pickup head has been solved by the structure disclosed in pending U.S. application Ser. No. 412,668 filed Nov. 5, 1973 entitled SURFACE CLEANING PICKUP HEAD by Jack L. Hommes and assigned to the present assignee. With such a system and with conventinal air blast-type pickup heads, the dust escape problem has not heretofore been satisfactorily solved.

Some attempts have beem made to introduce water into the air stream thus coagulating dust particles preventing their dispersing in the air and escaping from the apparatus. Thus, in one effort to control the dust, water was injected into the debris plenum in relatively large volumes to attempt to control the dust. It was found, hwoever, that in order to provide any degree of dust control, the amount of water necessary resulted in the formation of considerable sludge in the debris plenum and in the air flow path which was objectionable.

SUMMARY OF THE INVENTION

In order to eliminate the dust problem while still overcoming the difficulty encountered in prior attempts at dust control utilizing injection of water at a single location and in large volumes, the system of the present invention was developed. It was discovered that by injecting water into the air stream in a fine spray at both the air inlet of the pickup head and the input of the debris plenum, a relatively small quantity of water effectively controlled dust particles without clogging the system with sludge.

Apparatus embodying the present invention includes an air blast-type pickup head including an air intake and blower means coupled to said intake for supplying air to the head. The pickup head includes an air exhaust coupled to the input of a debris plenum which is also coupled to the inlet of the air blower completing the closed loop air flow path. A source of pressurized water is coupled to a first nozzle positioned in advance of the air inlet of the pickup head and to a second nozzle coupled in advance of the input of the debris plenum for injecting water at spaced locations in the air flow path and at relatively low flow rates to control dust.

The structure of the preferred embodiment of the invention and its features and advantages can best be understood by reference to the following description thereof together with the drawings in which:

DETAILED DESCRIPTION OF THE PREFERRED EMBODIMENT

Figure 1:
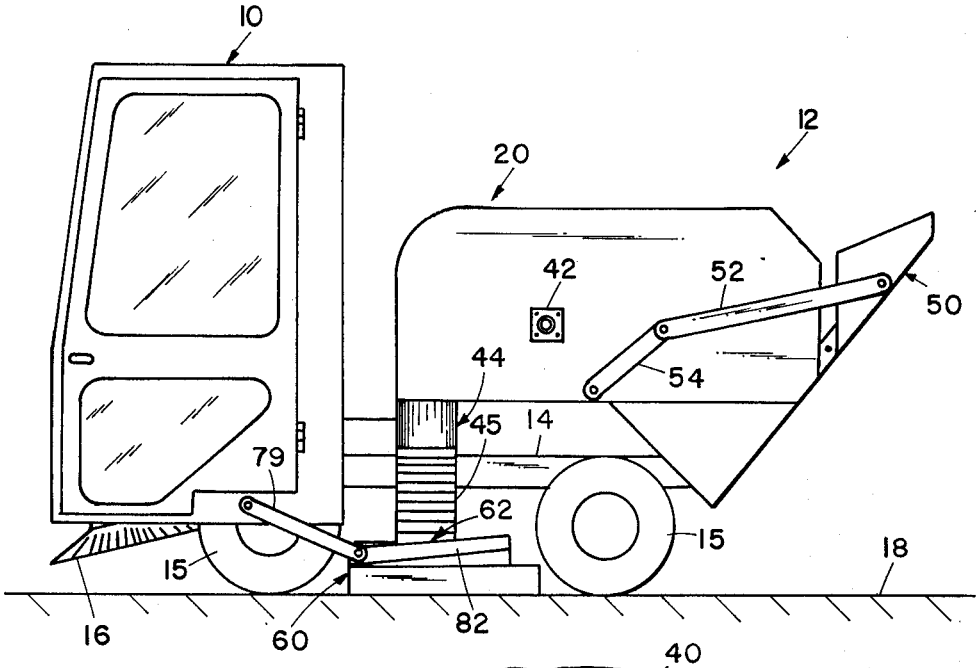
FIG. 1 is a left side elevational view of a mobile sweeper embodying the present invention.
Figure 5:
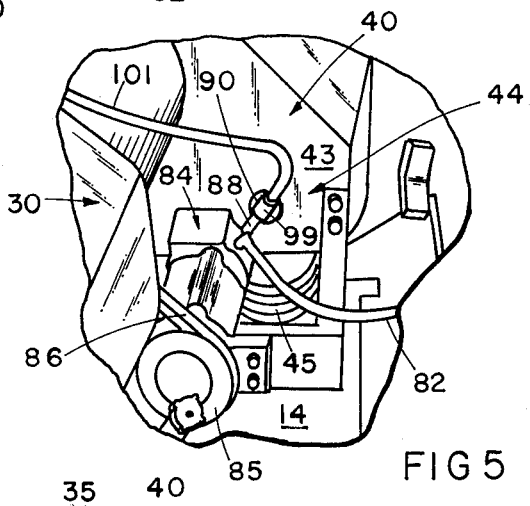
FIG. 5 is a fragmentary, perspective view from the top center of the sweeper shown in FIG. 1 looking downwardly toward th left side.
Figure 2:
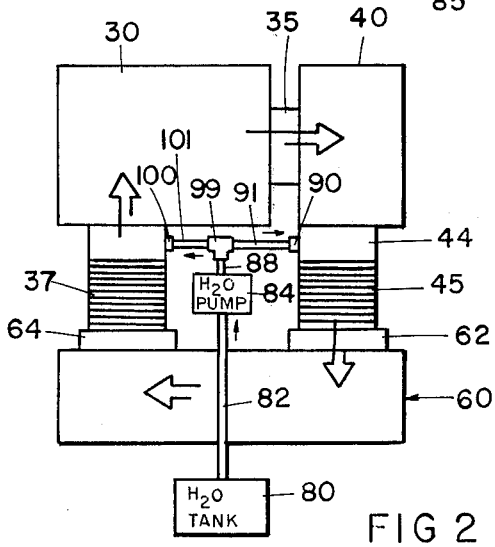
FIG. 2 is a schematic diagram showing the air and water flow paths of the sweeper shown in FIG. 1.

Referring to FIGS. 1, 2 and 5, there is shown a mobile sweeper embodying the present invention and which includes a cab 10 and a debris pickup section 12, both of which are mounted to a support frame 14 and supported by a plurality of wheels 15 which are driven by conventional drive means including a suitable engine for providing power for the vehicle's motion. The cab 10 includes a powered brush 16 which can be elevated as shown or lowered and rotated to engage the surface 18 to be cleaned.

The pickup end 12 of the vehicle includes an enclosure 20 housing a debris plenum 30 and an adjacent blower 40 (FIGS. 2 and 5). The blower is supported by housing 20 by means of suitable bearings 42, one of which is seen in FIG. 1. A drive motor is mounted within enclosure 20 for powering the blower in a conventional manner. Blower 20 is a standard blower having a rotary impeller with an inlet extending through a side wall 43 (FIG. 5) and aligned with the axis of the impeller and an exhaust 44 formed through the integral blower housing at the lower circumferential end as seen in FIG. 5. The debris plenum 30 comprises a chamber for collection of debris by the sweeper and includes an access door (not shown) for removal of debris. An unloading scoop 50 is mounted to the rear of section 12 and is actuatable by control arms 52 and 54 on either side of the unit for easy removal or transfer of debris from the debris plenum. Plenum 30 includes a debris and air input coupled to a pickup head 60 and an air outlet coupled to the blower air inlet by duct 33 (FIG. 5).

The blower unit 40 includes an exhaust 44 (FIG. 1) coupled to the air intake 62 of an air blast-type pickup head 60 by means of a collapsible and expandable flexible duct 45 coupling the two. Pickup head 60 includes an air and debris outlet 65 (FIGS. 3 and 4) similarly coupled to the input of the debris plenum 30 by duct 37 (FIG. 2). The flexible coupling of head 60 to the blower 40 and debris plenum 30 permits the head to be raised out of the way when not in use and lowered as shown during the operation of the sweeper. The pickup head 60 is described in detail in the above identified copending application incorporated herein by reference. A brief description of the structure of the pickup head, however, is presented here with reference to FIGS. 3 and 4.

The pickup head 60 comprises a sheet metal member bent into a vertically extending front wall 61, a sloping top wall segment 63, a rearwardly extending horizontal top wall segment 65 and a downwardly depending rear wall 67. The ends of the pickup hed are enclosed by means of end walls 66 also constructed of metal and secured to the front, top and rear walls defining sheet of metal by welding or the like. Formed downwardly through the horizontally extending portion of the top walls is the air intake 62 comprising an aperture in wall 65 surrounded by a sheet metal collar 62' to which the flexible duct 45 is attached. Head 60 also includes an air and debris outlet 64 comprising an aperture in wall 65 and sheet metal collar 64' extending above and below wall 65 to which a similar piece of flexible duct is attached for coupling the head to the debris plenum 30. The housing so formed is suspended from frame 14 by means such as a pair of spaced chains 69 permitting the raising and lowering of the pickup head from the surface to be cleaned by conventional means.

The interior of the pickup head is vertically divided into an air delivery plenum chamber and an exhaust chamber by means of an inclined partition and air nozzle means (not shown) to provide turbulent air flow across the surface 18 being cleaned. Intake 62 communicates with the upper air delivery plenum while outlet 64 communicates with the lower exhaust chamber through the downwardly depending extension of the collar 64'. The leading edge of the pickup head includes a pair of spaced resilient flaps 70 and 72 (FIG. 3) which extend downwardly from the front wall 61 to engage the surface to be cleaned. Similarly, a pair of rear flaps (not shown) depend downwardly from rear wall 67 to engage the surface being cleaned. The ends of the deflectable flaps extend slightly below the lower edge of end walls 66 to provide an effective seal between the four vertically extending walls of the pickup head so defined. The flaps deflect on contact with debris to permit entry of relatively large debris into the pickup head.

In order to increase the suctioning of the pickup head when large objects are to be ingested, a closure door 74 is pivotally mounted to the junction of rear wall 67 and top wall 65 and selectively restricts a plurality of apertures 75 formed in and spaced along rear wall 67 and communicating with the air delivery plenum. Door 74 is mounted to pivot axle 76 pivotally mounted between a pair of end brackets 78 each bolted to end wall 66.

Figure 4:
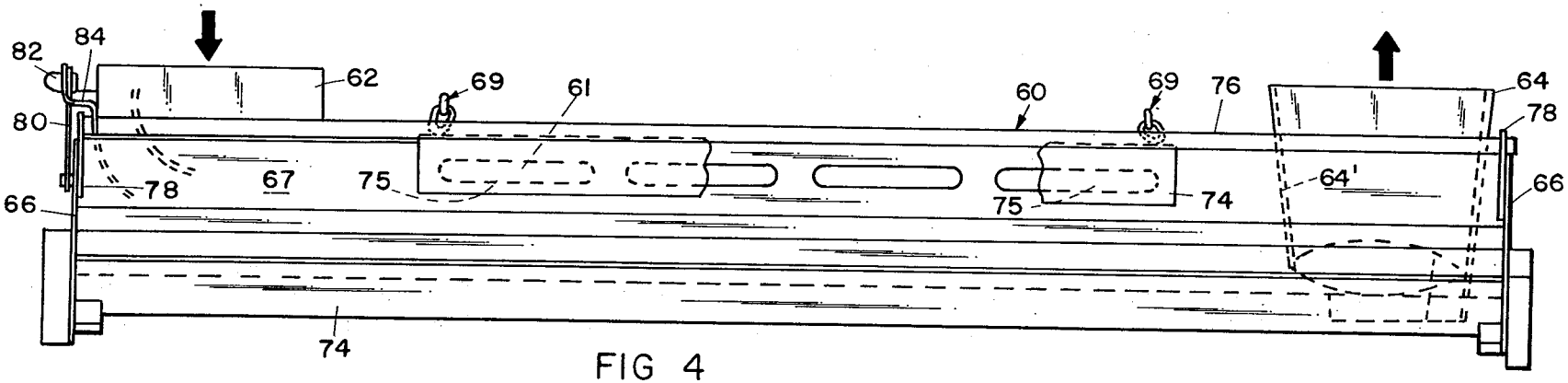
FIG. 4 is a rear elevational view of the pickup head shown in FIG. 3.
Figure 3:
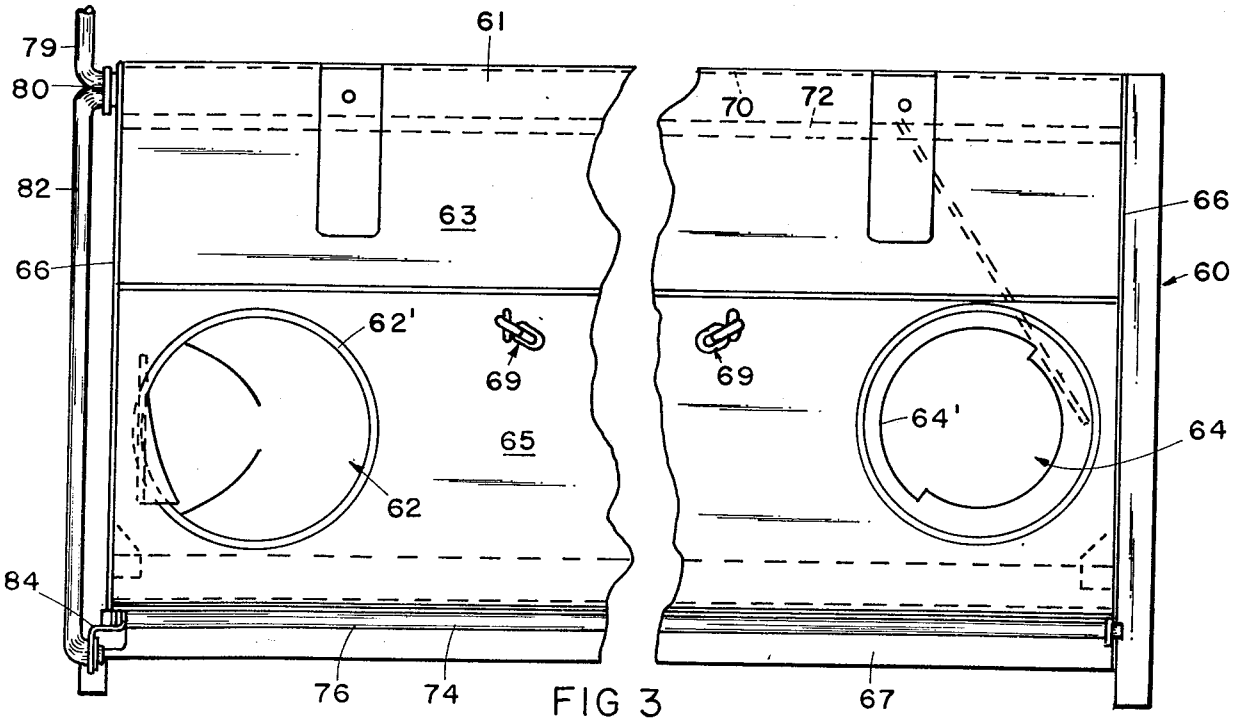
FIG. 3 is an enlarged plan view of the pickup head for the sweeper embodying the present invention.

Door 74 is controlled by the operator in cab 10 by means of an actuating link 79 extending into the cab and terminating at a suitable control lever and which extends rearwardly to and is coupled to a door control lever 80 (FIGS. 3 and 4). A tie rod 82 couples lever 80 to actuating lever 84 to selectively open or close door 74 as the link 79 is actuated by the operator. With door 74 in an open position, a substantial amount of air from the air delivery chamber is vented to the atmosphere. As the exhaust blower continues to maintain a substantially constant air flow from exhaust port 64, the suction of the pickup chamber is greatly increased thereby facilitating the ingestion of relatively large objects. Once the sweeper has passed the large object to be ingested, lever 79 is again actuated to close door 74 permitting normal operation of the pickup head.

Having briefly described the construction of the sweeper vehicle and the pickup head employed therewith, a detailed description of the dust control system therefor is presented in conjunction with FIGS. 2, 5, 6 and 7.

Figure 7:
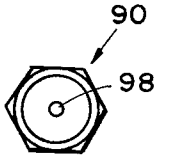
FIG. 7 is a right end view of the nozzle shown in FIG. 6.
Figure 6:
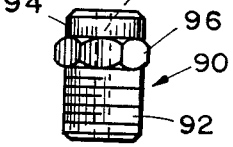
FIG. 6 is an enlarged side elevation of a nozzle employed for injecting water into the air stream of the system of the present inventon.

The dust control system includes a 6 gallon water tank 80 positioned at the rear of cab 10 at a suitable location. Leading from tank 80 is a water conduit 82 which extends to a water pump 84. Pump 84 includes a drive pulley 85 coupled to the motor for driving blower 40 by means of a drive belt 86 (FIG. 5). The output of pump 84 is coupled by a conduit 88 to a T-connector 99. One of the legs of connector 99 is coupled to a first nozzle 90 by a conduit 91. Nozzle 90 is mounted to the inner wall 43 (FIG. 5) of the blower exhaust outlet 44 slightly above flexible conduit 45. Nozzle 90 is threadably secured to wall 43 and communicates with the air stream slightly above the flexible coupling 45 to inject a relatively fine mist of water into the air stream between the blower and the intake of the pickup head. Nozzle 90 is shown in FIGS. 6 and 7 and comprises a brass member having a threaded end 92, a nozzle end 94 and an integral nut 96 for securing the nozzle end 94 and an integral nut 96 for securing the nozzle to plate 43. Nozzle 90 includes an axial aperture 98 defining an orifice at the nozzle end. The diameter of aperture 98 in the preferred embodiment is 0.042 inches. Conduit 91 leading to nozzle 90 from the T-connector is secured to the threaded end 92 thereof by conventional pipe coupling means.

The remaining leg of T-connector 99 couples conduit 88 from pump 84 and is coupled to a second nozzle 100 (FIG. 2) by a conduit 101. Nozzle 100 is substantially identical to nozzle 90 with the exception that the orifice has a smaller diameter of 0.028 inches. Nozzle 100 is mounted to the input of the debris plenum 30 and is positioned to communicate with and inject a fine spray of water into the air flow path between the pickup head outlet and the input to the debris plenum 30.

In operation, blower 40 circulates air in a closed loop path through the pickup head and debris plenum as indicated by the bold arrows in FIG. 2. In its path, the air picks up debris including dirt and fine particulate material from the surface being cleaned. Due to the turbulence of the air, considerable dust is produced. Pump 84 supplies nozzles 90 and 100 with pressurized water (about 15–20 psig) from tank 80 to provide a fine mist in the air stream between the blower and the pickup head and between the pickup head and the debris plenum, respectively, at a flow rate of approximately 0.12 gallons per minute during operation. It has been found that by positioning a pair of nozzles having different diameter orifices at these locations, the dust problem is virtually eliminated without clogging the system.

It will become apparent to those skilled in the art that nozzles 90 and 100 can be of different design than shown in the preferred embodiment and can be positioned at locations between the pickup head and debris plenum and blower different than that shown in the preferred embodiment so long as the nozzles are positioned to inject the water sprays between the pickup head and the debris plenum and blower. Although the flow rate, water pressure and nozzle orifices of the preferred embodiment have been found to provide optimum results, it will be appreciated that these parameters can be varied somewhat with satisfactory results. Also, the wetting agent employed may a fluid other than water. These and other modifications to the present invention will, however, fall within the spirit and scope of the invention as defined by the appended claims.

The embodiments of the invention in which an exclusive property or privilege is claimed are defined as follows:

1. In a sweeper including an air blast pickup head supplied with pressurized air from the exhaust of a blower and a debris collecting chamber coupled between the pickup head and the blower such that debris is picked up by the air stream through the pickup head and deposited in the debris collecting chamber, a dust control system comprising:

a source of pressurized fluid;

a first nozzle coupled to said source and positioned to provide a fine mist spray of fluid in the air flow path from said blower exhaust to said pick up head; and a second nozzle coupled to said source and positioned to provide a fine mist spray of fluid in the air flow path from said pickup head to the inlet of said blower.

2. The apparatus as defined in claim 1 wherein said first nozzle has a fluid delivery orifice of about 0.04 inches in diameter.

3. The apparatus as defined in claim 2 wherein said second nozzle has a fluid delivery orifice of about 0.03 inches in diameter.

4. The apparatus as defined in claim 3 wherein said pump delivers fluid to said first and second nozzles at a pressure of about 15–20 psig.

5. In a sweeper including an air blast pickup head supplied with pressurized air from the exhaust of a blower and a debris collecting chamber coupled between the pickup head and the blower such that debris is picked up by the air stream through the pickup head and deposited in the debris collecting chamber, a dust control system comprising:

a source of water;

first means coupled to said source of water and positioned between said blower exhaust and said pickup head to provide a fine mist spray of water into the air flow path leading into said pickup head;

second means coupled to said source of water and positioned between said pickup head and said debris collecting chamber to provide a fine mist spray of water into the air flow path leading from said pickup head; and means coupled between said source of water and said first and second means for pressurizing water supplied to said first and second means.

6. The apparatus as defined in claim 5 wherein said first and second means are nozzles.

7. The apparatus as defined in claim 6 wherein said last named means includes a pump for pressurizing water to a pressure of about 15–20 psig.

8. The apparatus as defined in claim 7 wherein said first nozzle has a fluid delivery orifice of about 0.04 inches in diameter.

9. The apparatus as defined in claim 8 wherein said second nozzle has a water delivery orifice of about 0.028 inches in diameter.

10. An air blast-type sweeper comprising:

an air blast pickup head including intake and outlet ports;

blower means including an exhaust outlet coupled to said intake port of said pickup head and an inlet;

a debris collection chamber having an input coupled to said outlet port of said pickup head and an outlet coupled to said inlet of said blower; and means for supplying a fine mist spray of wetting agent to the air flow path between said blower and said pickup head and to the air flow path between said pickup head and said debris plenum.

11. The apparatus as defined in claim 10 wherein said supplying means comprises:

a source of fluid wetting agent;

a first nozzle coupled between said blower exhaust and said pickup head to provide a spray of wetting agent in the air flow path therebetween;

a second nozzle coupled between said pickup head and said debris collecting chamber to provide a spray of wetting agent in the air flow path therebetween; and pump means coupled between said source and said first and second nozzles to supply pressurized wetting agent to said nozzles.

12. The apparatus as defined in claim 11 wherein said first nozzle has a fluid delivery orifice of about 0.04 inches in diameter.

13. The apparatus as defined in claim 12 wherein said second nozzle has a fluid delivery orifice of about 0.03 inches in diameter.

14. The apparatus as defined in claim 13 wherein said pump delivers fluid to said first and second nozzles at a pressure of about 15–20 psig.

15. The apparatus as defined in claim 1 wherein said first and second nozzles have apertures therein and wherein said second nozzle has an aperture smaller than the aperture of said first nozzle.

16. The apparatus as defined in claim 15 wherein said source of pressurized fluid comprises a tank and pump means coupled to said tank for providing fluid therefrom under pressure to said first and second nozzles.

* * * * *